US005174000A

United States Patent [19]

Wilhelm et al.

[11] Patent Number: 5,174,000

[45] Date of Patent: Dec. 29, 1992

[54] APPARATUS FOR SINGULARIZING DROP-WIRES IN WARP-THREAD DRAWING-IN MACHINES

[75] Inventors: Hans Wilhelm, Chur; Alfred Schneller, Zizers, both of Switzerland

[73] Assignee: Zellweger Uster AG, Uster, Switzerland

[21] Appl. No.: 747,345

[22] Filed: Aug. 20, 1991

[30] Foreign Application Priority Data

Aug. 20, 1990 [CH] Switzerland ..... 699/90

[51] Int. Cl.[5] ..... D03J 1/14

[52] U.S. Cl. ..... 28/205; 28/206

[58] Field of Search ..... 28/205, 206, 207, 208

[56] References Cited

U.S. PATENT DOCUMENTS

| | | | |
|---|---|---|---|
| 3,744,109 | 7/1973 | Dohi et al. | 28/206 |
| 4,047,270 | 9/1977 | John | 28/205 |
| 4,543,696 | 10/1985 | John et al. | 28/206 |
| 4,891,871 | 1/1990 | Tachibana et al. | 28/205 |

FOREIGN PATENT DOCUMENTS

| | | | |
|---|---|---|---|
| 688493 | 2/1940 | Fed. Rep. of Germany | 28/205 |
| 943930 | 3/1949 | France | 28/205 |
| 709424 | 5/1954 | United Kingdom | 28/205 |
| 781937 | 8/1957 | United Kingdom | 28/205 |

OTHER PUBLICATIONS

EP 298616, Jan. 1989, EPO Application.

*Primary Examiner*—Werner H. Schroeder
*Assistant Examiner*—Bibhu Mohanty
*Attorney, Agent, or Firm*—Burns, Doane, Swecker & Mathis

[57] ABSTRACT

A drawing-in machine for threading weaving machine harnesses is provided with apparatus for separating one at a time the drop-wires to be threaded from a stack of drop-wires. The stack of drop-wires is moved toward a stop located adjacent a slit. A selecting member (31) in the form of a friction wheel contacts the front face of the forwardmost drop-wire of the stack of drop-wires to urge that drop-wire transversely into the slit so as to separate that drop-wire from the stack. The selecting member moves the front drop-wire from the drop-wire stack into an intermediate position from which it can be separated completely from the stack and threaded with a warp thread. The drop-wires do not need to have any specific configuration at the point of application of the selecting member and they also do not need to be lined up or arranged in a specific manner. The friction wheel contacting the drop-wires at their front face is able to singularize all types of drop-wires.

13 Claims, 4 Drawing Sheets

APPARATUS FOR SINGULARIZING DROP-WIRES IN WARP-THREAD DRAWING-IN MACHINES

FIELD OF THE INVENTION

The present invention relates to apparatus for singularizing drop-wires in warp-thread drawing-in machines. It is concerned particularly with apparatus having a selecting member for drop-wires fed in the form of a stack, which selecting member separates individual drop-wires from the stack so that individual drop-wires may be prepared for the drawing-in of the warp threads.

BACKGROUND OF THE INVENTION

In hitherto known devices for singularizing drop-wires, the selecting member is formed by a selecting blade entering the drop-wire stack from above. Such selecting member penetrates into the drop-wire stack directly after the frontmost drop-wire of the stack and displaces the frontmost drop-wire lengthwise of the drop-wire stack to the drawing-in position. In such systems, if the drop-wires are to be reliably selected, it must be ensured that successive drop-wires of the drop-wire stack have various points of application for the selecting blade. This is achieved by virtue of the fact that drop-wires having a bevelled head are used and these drop-wires are lined up alternately with regard to the bevelling. This means that drop-wires different from these said drop-wires could not hitherto be drawn in automatically.

SUMMARY OF THE INVENTION

An object of the present invention is to provide universally usable apparatus for singularizing drop-wires, which apparatus enables all types of drop-wires to be selected without these drop-wires having to be lined up in a specific manner.

In accordance with an aspect of the invention, the selecting member is formed by a means acting on the front end of a drop-wire stack and fractionally transporting the actual frontmost drop-wire from the drop-wire stack into an intermediate position. Owing to the fact that the selecting member acts on the front end of the drop-wire stack and does not penetrate laterally into the same, the drop-wires do not need to have a specific configuration at a penetration point, and they also do not need to be lined up or arranged in a specific manner. On the contrary, the selecting member contacting the drop-wires at the front end of the stack is able to singularize all types of drop-wire.

BRIEF DESCRIPTION OF THE DRAWINGS

The invention is described in greater detail below with reference to an exemplary embodiment and the drawings, in which.

DETAILED DESCRIPTION OF PREFERRED EMBODIMENTS

Figure 1:
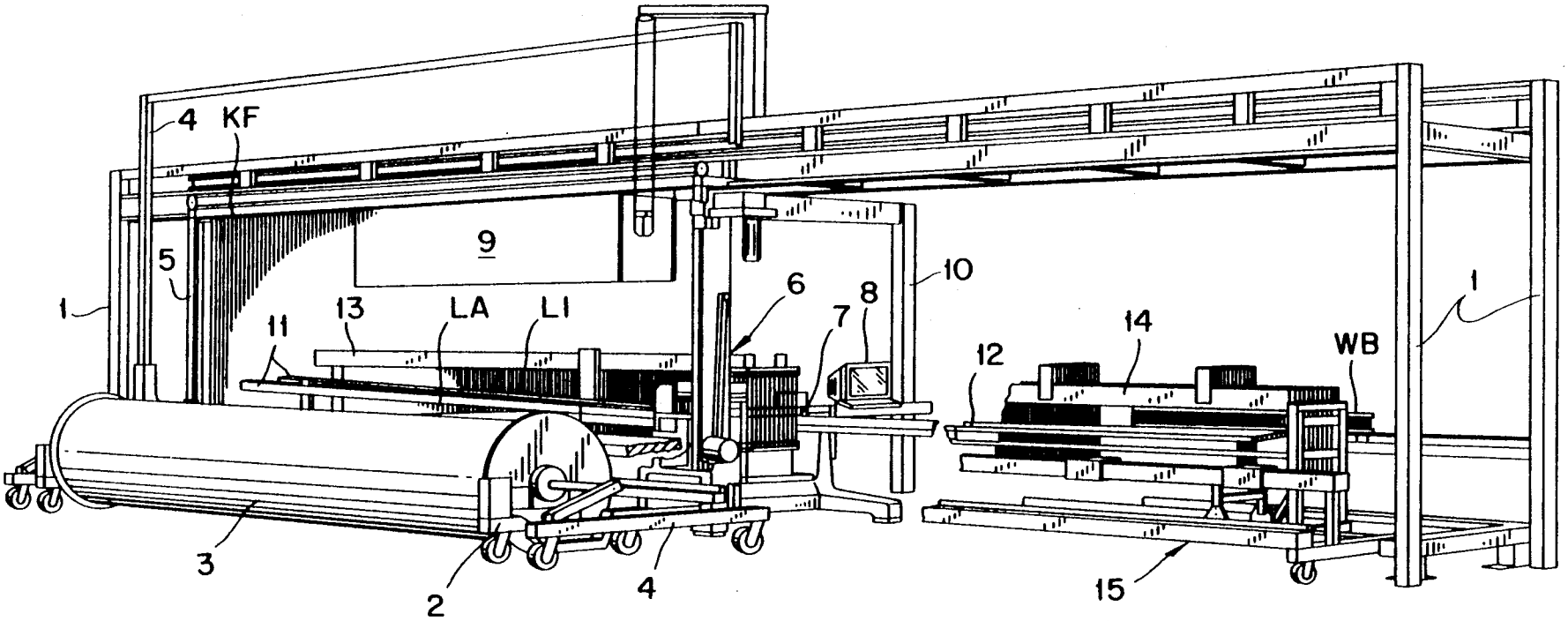
FIG. 1 shows a perspective overall representation of a warp-thread drawing-in machine.
Figure 2:
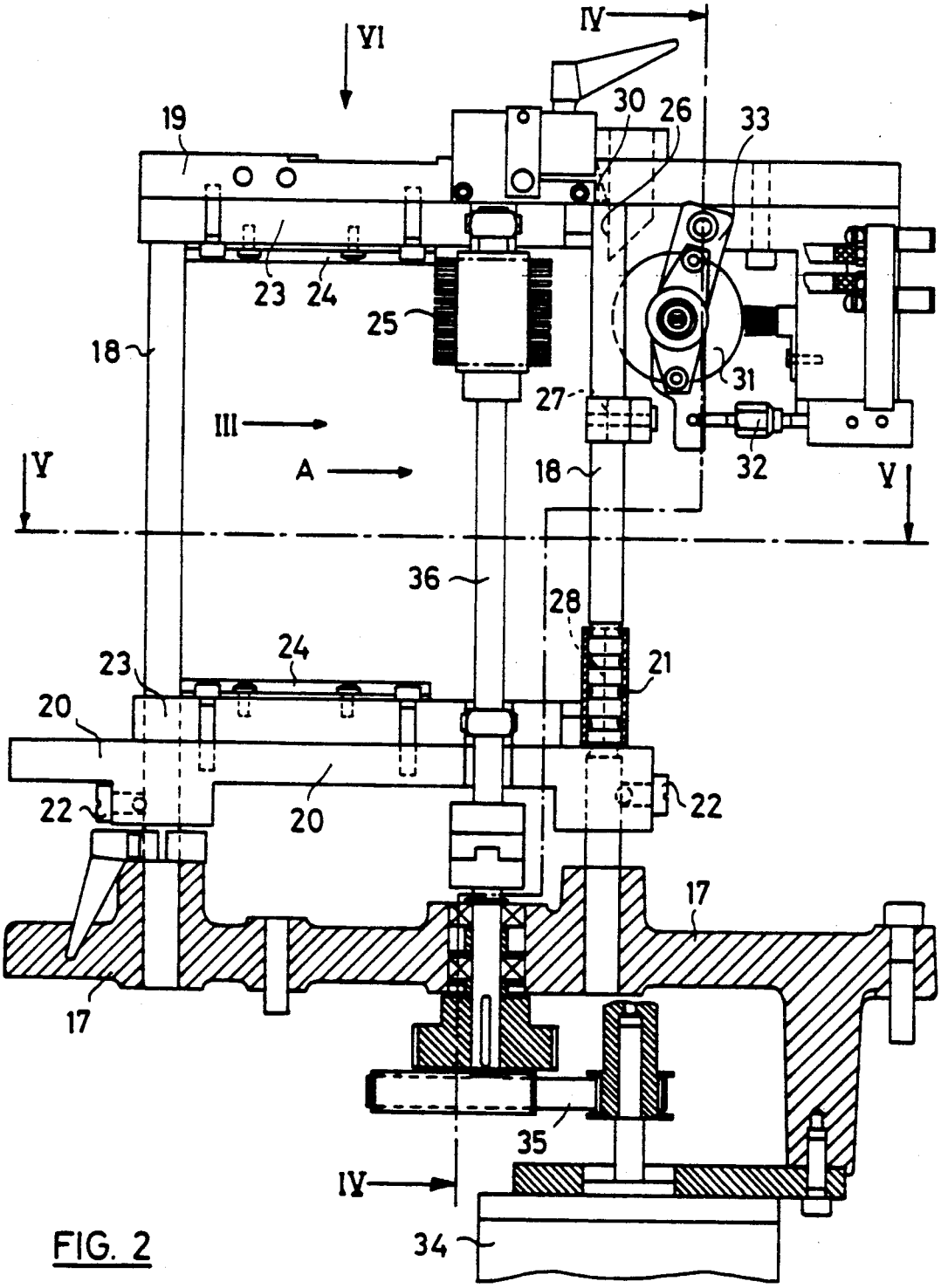
FIG. 2 shows a side view of a device according to the invention for singularizing drop-wires, partly in section.
Figure 3:
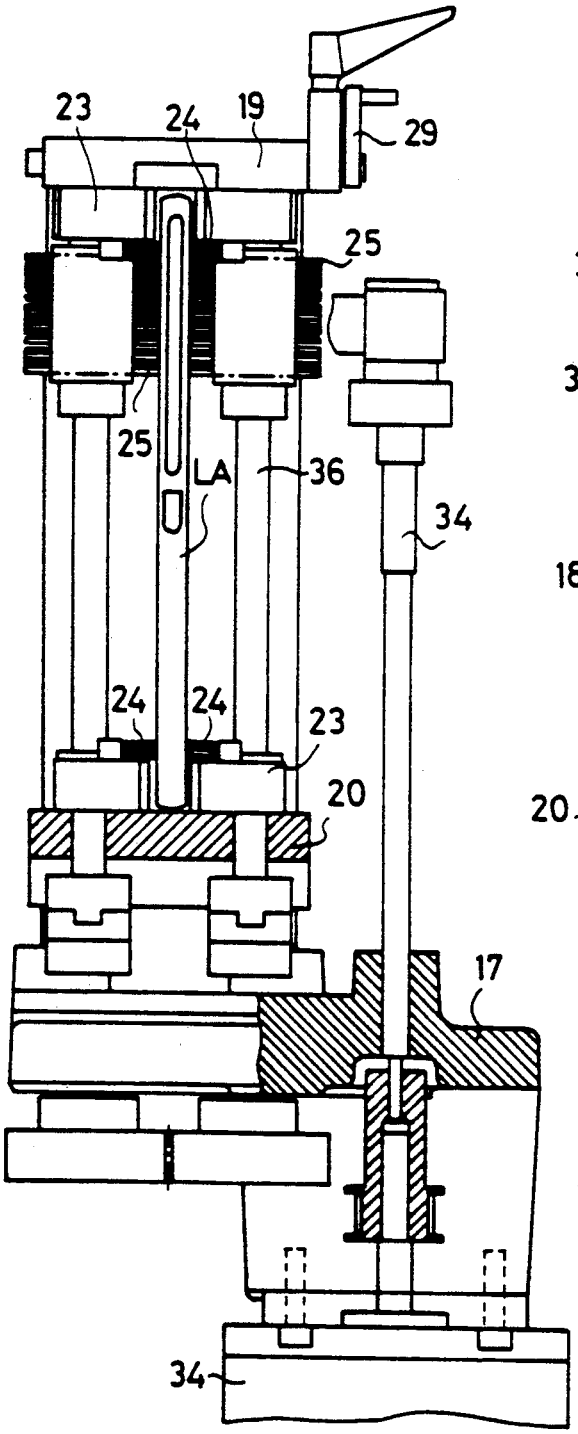
FIG. 3 shows a view in the direction of arrow III in FIG. 2.

According to FIG. 1, the drawing-in machine consists of a mounting stand 1 and various subassemblies arranged in this mounting stand 1. Each of these subassemblies represents a functional module. A warp-beam truck 2 with a warp-beam 3 arranged thereon can be recognized in front of the mounting stand 1. In addition, the warp-beam truck 2 contains a lifting device 4 for holding a frame 5 on which the warp threads KF are clamped. This clamping is effected before the actual drawing-in machine and at a location separate from the drawing-in machine, the frame 5 being positioned at the bottom end of the lifting device 4 directly next to the warp-beam 3. For the drawing-in, the warp-beam truck 2 together with warp-beam 3 and lifting device 4 is moved to the so-called setting-up side of the drawing-in machine and the frame 5 is lifted upwards by the lifting device 4 so it then assumes the position shown.

The frame 5 and the warp beam 3 are displaced in the longitudinal direction of the mounting stand 1. During this displacement, the warp threads KF are directed past thread-separating apparatus 6 and as a result are separated and selected. After the selection, the warp threads KF are cut off and presented to a drawing in needle 7, which forms a component of the so-called drawing in module. The selecting equipment employed for this operation may be of the type used heretofore in the warp tying machine sold under the designation USTER TOPMATIC by Zellweger Uster AG of Switzerland. USTER is a registered trademark of Zellweger Uster AG.

Next to the drawing in needle 7, there is a video display unit 8, which belongs to an operating station and serves to display machine functions and machine malfunctions and to input data. The operating station, which forms part of a so-called programming module, also contains an input stage for the manual input of certain functions, such as, for example, creep motion, start-stop, repetition of operations, and the like. The drawing-in machine is controlled by a control module which contains a control computer and is arranged in a control box 9. Apart from the control computer, this control box contains a module computer for every so-called main module, the individual module computers being controlled and monitored by the control computer. The main modules of the drawing-in machine, apart from the modules already mentioned (drawing-in module, yarn module, control module and programming module), are the heald, drop-wire, and reed modules.

The thread-separating apparatus 6 which presents the warp threads KF to be acted upon by the drawing-in needle 7, and the path of movement of the drawing-in needle 7 transverse to the plane of the clamped warp threads KF defines a plane in the area of a support 10 forming part of the mounting stand 1. This plane separates the setting-up side already mentioned from the so-called taking-down side of the drawing-in machine. The warp threads and the individual elements into which the warp threads are to be drawn-in are fed at the setting-up side, and the so called harness (healds, drop-wires and reed) together with the drawn-in warp threads can be removed at the taking down side. During the drawing-in, the frame 5 having the warp threads KF and the warp beam truck 2 for the warp beam 3 are moved to the right past the thread-separating apparatus 6. In the course of this movement, the drawing in needle 7 successively removes from the frame 5 the warp threads KF clamped on the latter.

When all warp threads KF are drawn in and the frame 5 is empty, the latter, together with the warp beam truck 2, the warp beam 3 and lifting device 4, are located on the taking-down side.

Arranged directly behind the plane of the warp threads KF are the warp-stop-motion drop-wires LA. Behind the latter are the healds LI, and the reed is further to the rear. The drop-wires LA are stacked in hand magazines. The full hand magazines are hung in sloping feed rails 11, on which they are transported to the right towards the drawing in needle 7. At this location they are separated and moved into the drawing-in position. Once drawing-in is complete, the drop-wires LA pass on drop-wire supporting rails 12 to the taking-down side.

The healds LI are lined up on rails 13 and shifted manually or automatically on the latter to a separating stage. The healds LI are then moved individually into their drawing-in position and, once drawing-in is complete, they are distributed over the corresponding heald shafts 14 on the taking down side. The reed is likewise moved step-by-step past the drawing-in needle 7, the corresponding reed gap being opened for the drawing-in. After the drawing-in, the reed is likewise located on the taking-down side. A part of the reed WB can be recognized to the right next to the heald shafts 14. This representation is to be understood as illustrative, since the reed, at the position shown of the frame 5, is of course located on the setting-up side.

A so-called harness truck 15 is provided on the taking-down side. This harness truck 15, together with the drop-wire supporting rails 12, fixed thereon, heald shafts 14 and a holder for the reed, are pushed into the mounting stand 1 into the position shown. After the drawing-in, the truck 15 carries the harness having the drawn-in warp threads KF. At this moment, the warp beam truck 2 together with the warp beam 3 is located directly in front of the harness truck 15. By means of the lifting device 4, the harness is now reloaded from the harness truck 15 onto the warp beam truck 2, which then carries the warp beam 3 and the drawn-in harness and can be moved to the relevant weaving machine or into an intermediate store.

The functions described are distributed over a plurality of modules which represent virtually autonomous machines which are controlled by the common control computer. The cross-connections between the individual modules run via this higher-level control computer and there are no direct cross-connections between the individual modules. The main modules already mentioned are themselves also of modular construction and as a rule include submodules. This modular construction is described in Swiss Patent Application No. 03 633/89-1 and corresponding International Application PCT/CH 90/00227, the disclosures of which are incorporated herein by reference in their entirety.

The drop-wire separating submodule of the drop-wire module is now to be described below. This submodule, which is shown in various views in FIGS. 2–6, follows in the transport direction of the drop-wires LA after the submodule drop-wire storing, which is described in U.S. application Ser. No. 07/702,020, the disclosure of which is incorporated herein by reference in its entirety.

It can be gathered from the last-mentioned patent application that the submodule drop-wire storing includes a movable elongated stand in which feed rails 11 for hand magazines carrying the drop-wires LA (FIG. 1) are mounted. The hand magazines are loaded with drop-wires and hung in the feed rails 11 in which they are transported towards a separating station where singularizing of the drop-wires takes place. This separating station is now to be described with reference to FIGS. 2–6.

Figure 6:
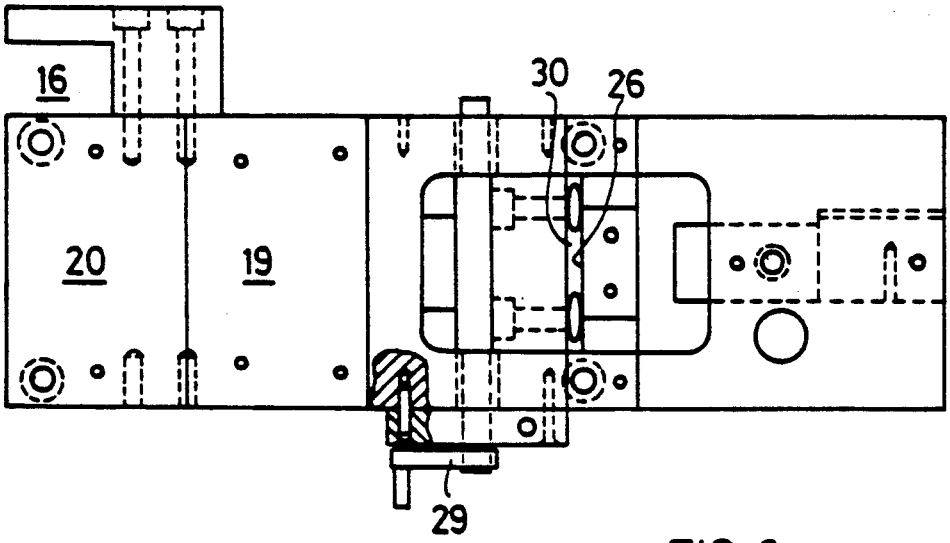
FIG. 6 shows a view in the direction of arrow VI in FIG. 2.

The separating station is designed in the form of an elongated box, whose one front end (FIG. 2, left) is provided as feeding side and whose other front end (FIG. 2, to right of center) is provided as delivery side for the drop-wires. At the feeding side, the drop-wires are pushed from the hand magazines of the submodule drop-wire storing into the separating station, and at the delivery side they are separated from their stack, the individual drop-wires being delivered sequentially from the separating station. Thus the separating station is connected at is left-hand side in FIGS. 2, 5 and 6 to the stand forming the submodule drop-wire storing, and in fact preferably by an appropriate coupling, which is indicated in FIG. 6 by a recess 16 provided for accommodating a coupling nose of the said stand. With regard to FIG. 2, a functional stage (not shown in further detail) is arranged above the separating station, which functional stage receives drop-wires delivered from the separating station and transfers them to a distributing station which positions the drop-wires in the warp-thread drawing in position.

The box-shaped part of the separating station, in which part the drop-wires LA are guided from the feeding side to the delivery side, includes a rectangular base plate 17, three guide rods 18 arranged in the base plate 17 at each of three corner points of the separating station, a top plate 19 and an intermediate plate 20. The top and intermediate plates 19 and 20 are carried and guided by the guide rods 18. The fourth corner point of the rectangle is not occupied by a point of the rectangle is not occupied by a guide rod 18, since the connection between the separating station and the submodule drop-wire storing is made in the area of this corner point (FIG. 6, recess 16). The intermediate plate 20 is vertically adjustable for adapting to the various lengths of drop-wire. For this purpose, two for the guide rods 18 are provided with spaced grooves 21 in which corresponding fixing screws 22 engage.

One pair of guide rails 23 is screwed to the inner surfaces, facing one another, of the top plate 19 and the intermediate plate 20. Between the guide rails is an alley which is slightly wider than the drop-wires LA and in which the drop-wires are displaced towards the delivery side. Strip brushes 24 for the exact lateral guidance of the drop-wires LA are screwed onto the guide rails 23. These strip brushes extend from the feeding side of the separating station up to vertically arranged rotating brushes 25, which displace the drop-wires passing into their effective area in the transport direction (arrow A) up to a stop. This stop is located in the connecting plane of the axes of the two guide rods 18 arranged to the right (as viewed in FIG. 2) of the rotating brushes 25 and it is formed by top, center and bottom webs 26, 27 and 28.

A nose 30 is adjustably mounted in spaced relation to the top web 26 by means which includes a crank 29 through the operation of which the distance of the nose 30 from the web 26 can be set to predeterminable values. As a result, a slit of defined width is formed between web 26 and nose 30. This width is at least as great as the thickness of a single drop-wire LA and less than the combined thickness of two of the drop-wires LA in the stack of drop-wires being processed, so that only one drop-wire at a time can be delivered from the stack up through the said slit.

Figure 4:
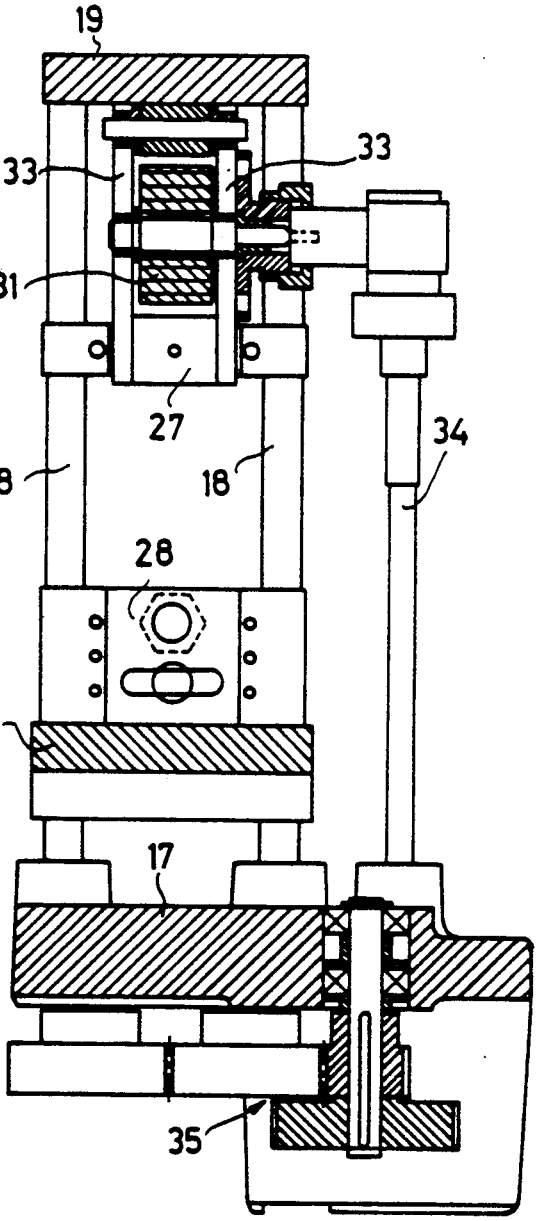
FIG. 4 shows a section along line IV—IV in FIG. 2.
Figure 5:
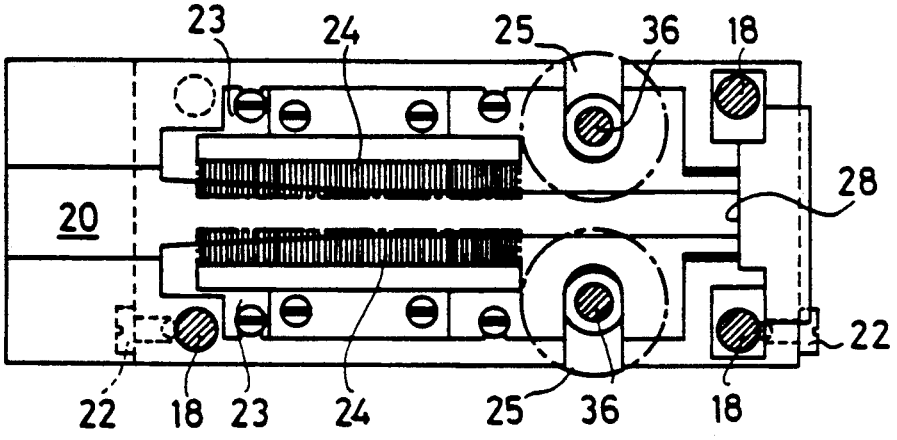
FIG. 5 shows a section along line V—V in FIG. 2.

The frontmost drop-wire LA in each case, pressed by the rotating brushes 25 against the stop 26, 27, 28, is separated from the drop-wire stack by a friction wheel 31. The latter is mounted on a lever 33 which is swingable about a pivot at its upper end portion and which is moved by a pneumatic cylinder 32. The friction wheel 31 is continuously driven via a flexible shaft 34 (FIG. 4). The pneumatic cylinder 32 alternatively presses the friction wheel 31 against the drop-wire to be selected or swings it away from the same. The frequency of this pivoting movement is controlled with reference to the warp thread drawing-in frequency which is set at the machine. During contact between the friction wheel 31 and the frontmost drop-wire, the latter is conveyed by the friction wheel 31 (rotating clockwise with regard to FIG. 2.) up through the slit between web 26 and the nose 30. The drop-wire separated in this way stops at a sensor, and in fact in a position where about one-third of its length has passed the slit. In this position, the drop-wire is received by a flight of a conveyor chain and then moved into a defined transfer position. The conveyor chain is driven intermittently via a suitable coupling.

The rotating brushes 25 and the friction wheel 31 are driven by a common motor 34 (FIG. 2) which is fastened to the base plate 17. The motor 34 directly drives the flexible shaft 34 and indirectly drives the rotating brushes 25 via a belt and gear drive 35. This belt and gear drive 35 acts on drive shafts 36 which carry the rotating brushes 25 and are mounted at their top end in the top plate 19 in such a way that their mutual spacing is adjustable so that the space between the brushes 25 can be set to the width of the respective drop-wires LA. The drive shafts 36 carrying rotating brushes 25 are preferably pressed together so that the brushes 25 press flexibly against the side edges of the drop-wire stack.

When the frontmost drop-wire is separated from its stack, such drop-wire slides along the next drop-wire during the entire separating operation and relatively high friction has to be overcome. This friction can be drastically reduced if the bottom stop 28 is of stepped design and has a step-like projection protruding beyond the vertical stop plane in the area of the bottom end of the drop-wires LA. The drop-wires are then no longer positioned exactly vertically at the stop 26, 27, 28 but are slightly tilted, in which case they are set back with the bottom end in transport direction A towards the stop plane apparent from FIG. 2.

With this arrangement, the frontmost drop-wire to be separated bears against the next drop-wire only as long as its bottom end bears on the projection of the bottom stop 28. As soon as the drop-wire has passed this projection, its bottom end springs forward towards the vertical stop plane and the drop-wire is released over most of its length. As a result, the separating is substantially facilitated.

If required, after the drop-wire is released, the selecting operation can also be assisted by a blade-like member reaching into the gap which then exists between the vertically hanging frontmost drop-wire and the tilting drop-wire stack and pulling the drop-wire stack to the rear against the transport direction A to such an extent that there is only slight friction between the frontmost drop-wire and the drop-wire stack, so that in particular the head edge of the drop-wire just pushed up out of the drop-wire stack does not damage the next drop-wire.

What is claimed is:

1. In a drawing-in machine of a type in which warp yarns are threaded through weaving harnesses that include drop-wires, apparatus for separating individual drop-wires from a supply stack of face-to-face drop-wires comprising means for urging the stack of drop-wires along a path in a direction extending longitudinally of said stack;

stop means against which the forwardmost of the drop-wires of the stack may bear when said stack is urged in said direction;

means providing a slit located to one side of the front end portion of said path, said slit being of a size to permit only one of said drop-wires to be passed transversely from said stack and into said slit at a given time;

selecting means for separating the frontmost drop-wire from the stack, said selecting means comprising a friction member for engaging the front face of the frontmost drop-wire of the stack when such drop-wire bears against said stop means; and drive means for moving said friction member in a direction having a component extending toward said slit to shift the frontmost drop-wire transversely with respect to the length of said stack and into said slit.

2. Device according to claim 1, wherein the friction member is formed by a friction wheel.

3. Device according to claim 2, wherein the friction wheel is continuously driven during operation and is alternatively pressed against or distanced from the drop-wire to be selected.

4. Device according to claim 3, wherein the friction wheel is mounted on a pivoted lever adjustable by a controlled pneumatic cylinder.

5. Device according to claim 2, including a separation station having a delivery side and a feeding side, and transport and guide means for the drop-wires in a transport direction from the feeding side to the delivery side, said friction wheel being arranged on said delivery side, and at the feeding side, the separation station having means for detachably coupling to a drop-wire feed station which can be fed with drop-wires in the form of a drop-wire stack and in which means are provided for displacing the drop-wire stack towards the separation station.

6. Device according to claim 5, wherein the said stop means have an opening for the passage of the friction wheel to the drop-wire to be selected, and wherein the slit for the discharge of the drop-wires from the separating station is formed in the area of the stop.

7. Device according to claim 6, wherein the slit is formed between a fixed web forming part of the stop and a nose adjustable relative to this web.

8. Device according to claim 7, wherein the means for urging the drop-wire stack in the direction longitudinally of the stack serves to displace said stack towards the stop means and comprise driven rotatable brushes.

9. Device according to claim 8, wherein a common drive is provided for the rotatable brushes and for the friction wheel.

10. Device according to claim 6, wherein rail-like guides are provided for the drop-wire stack in the area of the top and bottom ends of the drop-wires.

11. Device according to claim 10, wherein the width of the rail-like guides is adjustable for adapting to drop-wires of different widths and is set to be larger than the width of the drop-wires, and in that the drop-wires are guided in the rail like guides by strip brushes.

12. Device according to claim 11, wherein the rail like guides and the strip brushes are mounted on plates which fix the drop-wire stack in the vertical direction, and wherein the slit for the frontmost drop-wire is formed on or in the area of one of these plates.

13. Device according to claim 12, wherein one of the two plates, is vertically adjustable for adapting to drop-wires of different lengths.

* * * * *